US007880709B2

(12) United States Patent
Yoshida et al.

(10) Patent No.: US 7,880,709 B2
(45) Date of Patent: Feb. 1, 2011

(54) DISPLAY AND PROJECTION TYPE DISPLAY

(75) Inventors: Asami Yoshida, Tokyo (JP); Minoru Matsuura, Kanagawa (JP); Takashi Hirakawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 572 days.

(21) Appl. No.: 10/983,754

(22) Filed: Nov. 8, 2004

(65) Prior Publication Data

US 2005/0162368 A1 Jul. 28, 2005

(30) Foreign Application Priority Data

Nov. 18, 2003 (JP) ..... P2003-388258

(51) Int. Cl.
*G09G 3/36* (2006.01)

(52) U.S. Cl. ..... 345/98; 345/87; 345/99

(58) Field of Classification Search ..... 345/698, 345/208, 214, 1.2, 1.1, 2.1, 5, 7–9, 31, 51, 345/55–111, 87–100
See application file for complete search history.

(56) References Cited

U.S. PATENT DOCUMENTS

| | | | | |
|---|---|---|---|---|
| 5,689,592 | A * | 11/1997 | Ericsson et al. | 382/304 |
| 5,912,700 | A * | 6/1999 | Honey et al. | 348/157 |
| 6,088,008 | A * | 7/2000 | Reeder | 345/33 |
| 6,346,936 | B2 * | 2/2002 | Murayama et al. | 345/208 |
| 6,556,191 | B1 * | 4/2003 | Ouchi | 345/204 |
| 2002/0149558 | A1 * | 10/2002 | Kashima et al. | 345/100 |
| 2002/0158823 | A1 * | 10/2002 | Zavracky et al. | 345/87 |

FOREIGN PATENT DOCUMENTS

| | | |
|---|---|---|
| JP | 08-242391 | 9/1996 |
| JP | 09-018812 | 1/1997 |
| JP | 10-171421 | 6/1998 |
| JP | 11-065536 | 3/1999 |
| JP | 11-119746 | 4/1999 |

(Continued)

OTHER PUBLICATIONS

Japanese Office Action issued on Apr. 8, 2008 in connection with JP Application No. 2003-388258.

(Continued)

*Primary Examiner*—Alexander Eisen
*Assistant Examiner*—Christopher E Leiby
(74) *Attorney, Agent, or Firm*—SNR Denton US LLP

(57) ABSTRACT

A display with a display unit is configured so that pixels are arrayed in a matrix. A clock pulse generating means generates clock pulses of any frequency. Based on the generated clock pulses, a pulse generating means generates timing signals for parallel arrangement processing video signals in units of a plurality of pixels as pulse signals enabling free setting of a pulse width and a pulse period. A phase deviation detecting means detects the amounts of phase deviation after write signals generated based on the timing signals and for writing video signals into the plurality of pixels pass through the display unit. The timing adjusting means automatically performs adjustment so that the amount of phase deviation is within the predetermined range (so that it becomes almost zero) based on the amounts of phase deviation detected by the phase deviation detecting means.

9 Claims, 12 Drawing Sheets

FOREIGN PATENT DOCUMENTS

| | | |
|---|---|---|
| JP | 11-175033 | 7/1999 |
| JP | 2000-047644 | 2/2000 |
| JP | 2000-089728 | 3/2000 |
| JP | 2000-341554 | 12/2000 |
| JP | 2001-166743 | 6/2001 |
| JP | 2002-072987 | 3/2002 |
| JP | 2002-108299 | 4/2002 |
| JP | 29002-108299 | 4/2002 |
| JP | 2003-015579 | 1/2003 |
| JP | 2003-157064 | 5/2003 |
| JP | 2004-125911 | 4/2004 |

OTHER PUBLICATIONS

Japanese Office Action issued on Sep. 15 in connection with JP Application No. 2003-388258.

* cited by examiner

MCK
HST
HCK
HCKX
SFP1
SFP2
SFP3
SFP4
SFP5
SFP6
SFP7
DCK1
DCK2
SPLS1
SPLS2
SPLS3
SPLS4
SPLS5
SPLS6
SPLS7

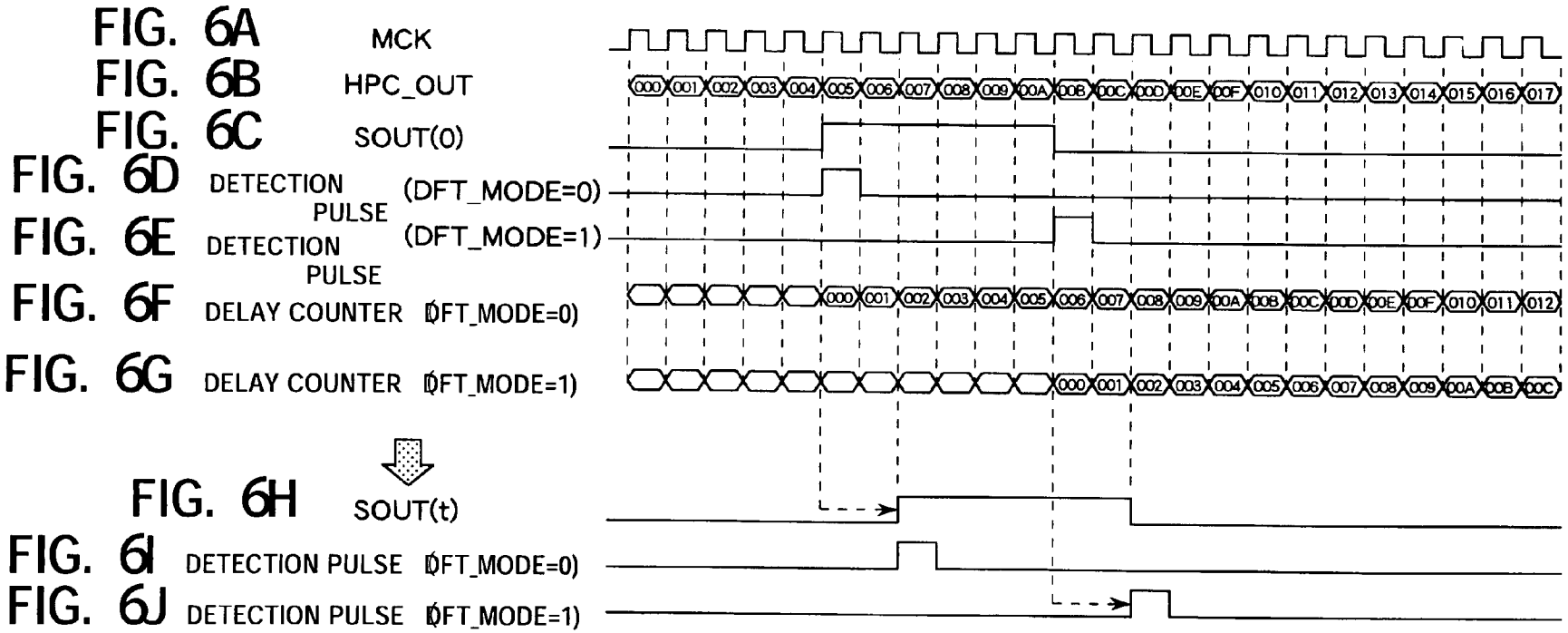
FIG. 6A MCK
FIG. 6B HPC_OUT
FIG. 6C SOUT(0)
FIG. 6D DETECTION PULSE (DFT_MODE=0)
FIG. 6E DETECTION PULSE (DFT_MODE=1)
FIG. 6F DELAY COUNTER (DFT_MODE=0)
FIG. 6G DELAY COUNTER (DFT_MODE=1)
FIG. 6H SOUT(t)
FIG. 6I DETECTION PULSE (DFT_MODE=0)
FIG. 6J DETECTION PULSE (DFT_MODE=1)

FIG. 8A MCK
FIG. 8B DCKC_OUT(0)
FIG. 8C DCK (0)
FIG. 8D DCKC_OUT(t)
FIG. 8E DCK(t)
2CLK
FIG. 8F DELAY COUNTER
FIG. 8G DECODE PULSE
FIG. 8H DECODE PULSE (F/B PROCESSING)
FIG. 8I DECODE PULSE (F/B PROCESSING)

DISPLAY AND PROJECTION TYPE DISPLAY

RELATED APPLICATION DATA

The present application claims priority to Japanese Application(s) No(s). P2003-388258 filed Nov. 18, 2003, which application(s) is/are incorporated herein by reference to the extent permitted by law.

BACKGROUND OF THE INVENTION

1. Field of the Invention

The present invention relates to a display apparatus, a control method of the same, and a projection type display apparatus, more particularly relates to a display and a projection type display (projector) employing the system of writing video signals in parallel by a plurality of pixels at a time in a horizontal direction (column array direction) in a display unit having pixels arrayed in a matrix.

2. Description of the Related Art

In a display, for example a liquid crystal display (LCD) using liquid crystal cells as display elements of the pixels, it is generally used a digital signal processing IC formed by an MOS process of a gate array as a signal processing system. The digital data subjected to predetermined signal processing by this digital signal processing IC is converted to an analog signal by a digital/analog (D/A) converter, then given to a liquid crystal panel (hereinafter described as an "LCD panel") via an LCD driver. The LCD panel is provided with pixels including liquid crystal cells arrayed in a matrix.

The write speed of an LCD panel is not fast enough to enable sequentially writing of input video signals by one dot (pixel) at a time, therefore, in general, a method of writing video signals in parallel by a plurality of pixels at a time in the horizontal direction is employed. In an LCD of this simultaneous pixel write system, it is necessary to convert video signals sequentially input in a time sequence to a plurality of pixels' worth of the parallel signals for writing the video signals in parallel to a plurality of pixels.

For example, in a case of an LCD of a six-pixel simultaneous write system for writing pixels by six pixels at a time in parallel in the horizontal direction, video signals input in time sequence are converted to six parallel video signals so that the six pixels have the same timing. The video signals are written in parallel into six columns of signal lines in six pixels' worth of time. This parallel processing is carried out when sampling/holding the video signals in the LCD driver.

A sample/hold pulse used for this parallel processing is generated as a timing signal synchronized with a horizontal synchronization signal. Further, signal lines for transmitting six parallel video signals are physically connected to the LCD panel as interconnects. Therefore, the start position of the image is unambiguously determined by the above timing signal and a display start timing signal to the LCD panel.

On the other hand, inside the LCD panel, in order to write six pixels at a time in parallel, signal line selection switches for selecting six signal lines at a time in parallel are provided in units of six signal lines. Then, these signal line selection switches are sequentially selected by switch pulses (write signals) sequentially generated in synchronization with the video signals. By the signal line selection switches being sequentially selected, video signals are written into six signal lines in parallel through the selected signal line selection switches.

Here, inside the LCD panel, the switch pulses and the video signals are distorted due to the influence of the resistances or the capacitances of the signal lines for transmitting them, therefore, an optimum display image cannot be obtained unless the phase relationships between these switch pulses and video signals are adjusted. When the optimum phase relationship is not exhibited, the video signals leak before or after the six pixels adjacent to the position where they should originally exist, so end up forming double images. For example, when displaying one vertical line, if this phase relationship is off, the vertical line will also be displayed before or after the six pixels from the position where they should originally exist.

For this reason, in the past, technology has been proposed enabling adjustment of the phase relationships between the timing signal for the simultaneous write operation, that is, the switch pulses (write signals), and the video signals with a dot clock precision or more without changing the center position of the image (refer to for example Japanese Unexamined Patent Publication (Kokai) No. 2002-108299 (particularly paragraphs 0039 to 0049 and FIG. 7)). This prior art calls for adjusting the phase of the pulse signal serving as the reference of the generation of the switch pulse at the timing generation circuit so as to enable the adjustment of the phase relationships between the video signals and the switch pulses with a dot clock precision or more without changing the center position of the image.

The prior art was effective for adjustment of the phase relationships between the write signals for the simultaneous write operation and the video signals at the LCD before shipping, but could not deal with the deviation of the phase relationships between the two after shipping. Namely, even if optimum phase adjustment is possible before shipping, if the circuit elements deteriorate due to a temperature change or aging, delays end up occurring in liquid crystal drive pulses due to this, so the phase relationships become off and the optimum display image can no longer be obtained.

SUMMARY OF THE INVENTION

An object of the present invention is to provide a display able to always obtain the optimum display image by automatically eliminating deviation of the phase relationships due to a temperature change or aging, a control method of the same, and a projection type display.

To attain the above object, according to a first aspect of the invention, there is provided a display apparatus comprising a display unit having a plurality of pixels arranged in a matrix, a clock pulse generating unit for generating a desired frequency clock pulse, a pulse generating unit for generating a timing pulse, based on the clock pulse, for parallel-processing image signals as a unit of a plurality of the pixels, a pulse width and a pulse period of the timing pulse being set at desired values, a detection unit for detecting a phase shift between a write pulse, which is generated based on the timing pulse, for writing the image signals in parallel by the plurality of pixels, and a reference pulse provided by the display unit as a reference of the write pulse, and a timing adjustment unit for timing-adjusting the timing pulse so that the phase shift is in a predetermined value.

Further, to attain the above object, according to a second aspect of the invention, there is provided a display apparatus comprising a display unit having a plurality of pixels arranged in a matrix, a clock pulse generating unit for generating a desired frequency clock pulse, a pulse generating unit for generating a timing pulse, based on the clock pulse, for parallel-processing image signals as a unit of a plurality of the pixels, a pulse width and a pulse period of the timing pulse being set at desired values, a detection unit for detecting a phase shift between a write pulse, which is generated based on the timing pulse, for writing the image signals in parallel by the plurality of pixels, and a reference pulse provided by the display unit as a reference of the write pulse, and a timing adjustment unit for timing-adjusting the timing pulse so that the phase shift is in a predetermined value, wherein the detection unit and the timing adjustment unit are located just close to an output portion of the reference pulse in the display unit.

To attain the above object, according to a third aspect of the invention, there is provided a projection type display apparatus for projecting a light emitted by a light source and display the light on a screen through a display unit having a plurality of pixels arranged in a matrix, comprising a clock pulse generating unit for generating a desired frequency clock pulse, a pulse generating unit for generating a timing pulse, based on the clock pulse, for parallel-processing image signals as a unit of a plurality of the pixels, a pulse width and a pulse period of the timing pulse being set at desired values, a detection unit for detecting a phase shift between a write pulse, which is generated based on the timing pulse, for writing the image signals in parallel by the plurality of pixels, and a reference pulse provided by the display unit as a reference of the write pulse, and a timing adjustment unit for timing-adjusting the timing pulse so that the phase shift is in a predetermined value.

According to the display according to the first aspect of the invention, the clock pulse generating unit generates a disired frequency clock pulse. The pulse generating unit generates a timing pulse, based on the clock pulse, for parallel-processing image signals as a unit of a plurality of the pixels. A pulse width and a pulse period of the timing pulse are set at desired values. The detection unit detects a phase shift between a write pulse, which is generated based on the timing pulse, and writes the image signals in parallel by the plurality of pixels, and a reference pulse provided by the display unit as a reference of the write pulse. The timing adjustment unit timing-adjusts the timing pulse so that the phase shift is in a predetermined value.

BRIEF DESCRIPTION OF THE DRAWINGS

These and other objects and features of the present invention will become clearer from the following description of the preferred embodiments given with reference to the attached drawings, wherein:

FIG. 6 is a timing chart showing the operation for finding an amount of delay of a scan pulse SOUT;

DESCRIPTION OF THE PREFERRED EMBODIMENTS

Preferred embodiments of the present invention will be described in detail below while referring to the attached figures.

First Embodiment

Figure 1:
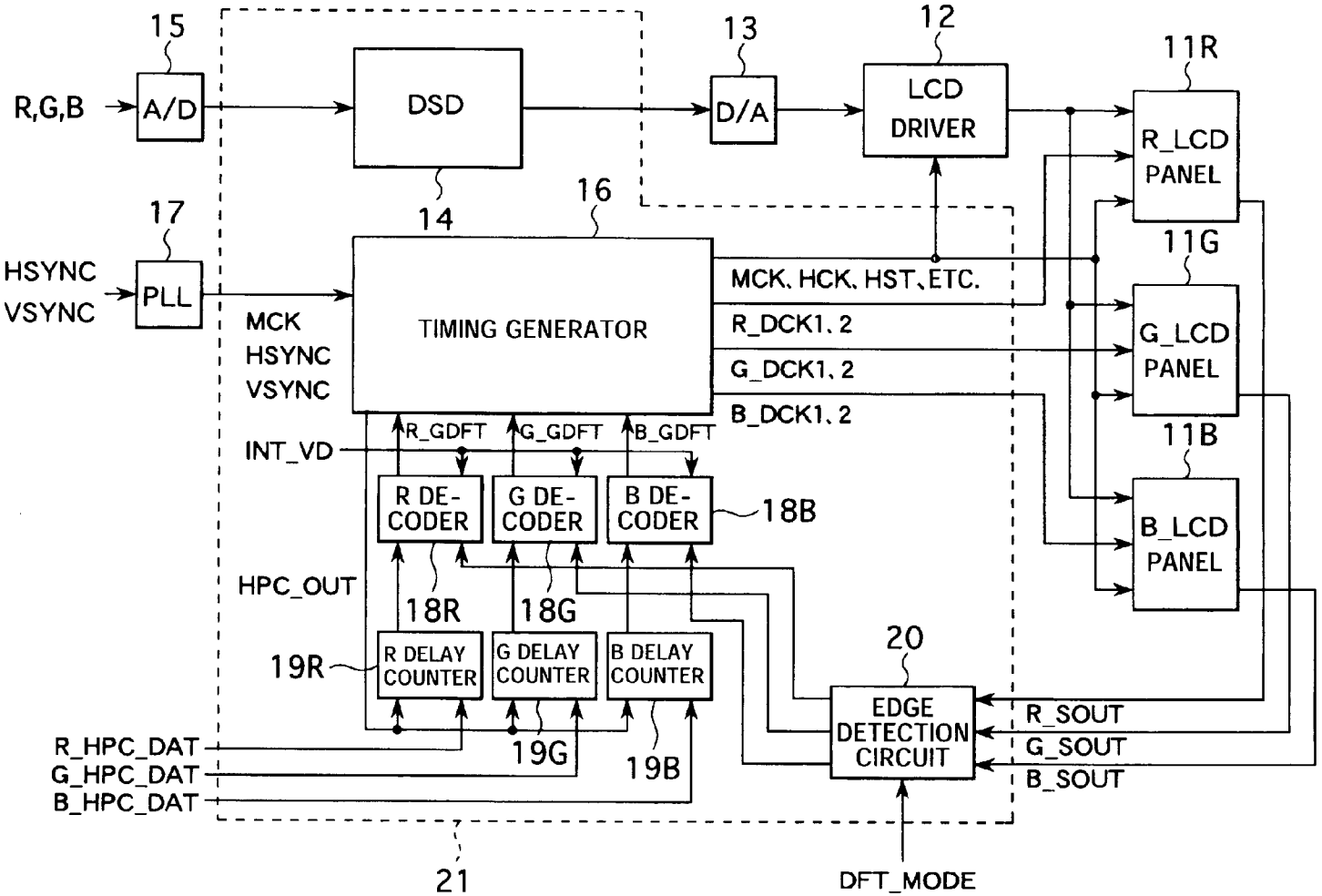
FIG. 1 is a block diagram of the system configuration of an LCD according to a first embodiment of the present invention.

Below, a detailed explanation will be given of a first embodiment of the present invention by referring to the drawings. FIG. 1 is a block diagram of the system configuration of a display according to an embodiment of the present invention, for example, an LCD using liquid crystal cells as display elements of the pixels.

As shown in FIG. 1, the LCD is comprised of LCD panels 11R, 11G, and 11B corresponding to R (red), G (green), and B (blue), an LCD driver 11, a D/A converter 13, a digital signal driver (DSD) 14, an A/D converter 15, a timing generator 16, a PLL circuit 17, R, G, B decoders 18R, 18G, and 18B, R, G, B delay counters 19R, 19G, and 19B, and an edge detection circuit 20.

Here, the digital signal driver 14, the timing generator 16, the R, G, B decoders 18R, 18G, and 18B, the R, G, B delay counters 19R, l9G, and 19B, and the edge detection circuit 20 configure a drive control circuit 21 for driving the LCD panels 11R, 11G, and 11B. In the present embodiment, it is assumed that this drive control circuit 21 is formed as an IC on one chip. This IC-formed drive control circuit 21 will be referred to as a "drive IC 21" below.

The A/D converter 15 converts R, G, and B analog video signals to digital video signals and supplies them to the digital signal driver 14. The digital signal driver 14 performs signal processing for usual image quality adjustment such as white balance adjustment and gamma correction. The D/A converter 13 converts the R, G, and B digital video signals subjected to various signal processing at the digital signal driver 14 to analog video signals again and supplies the same to the LCD driver 12.

Figure 2:
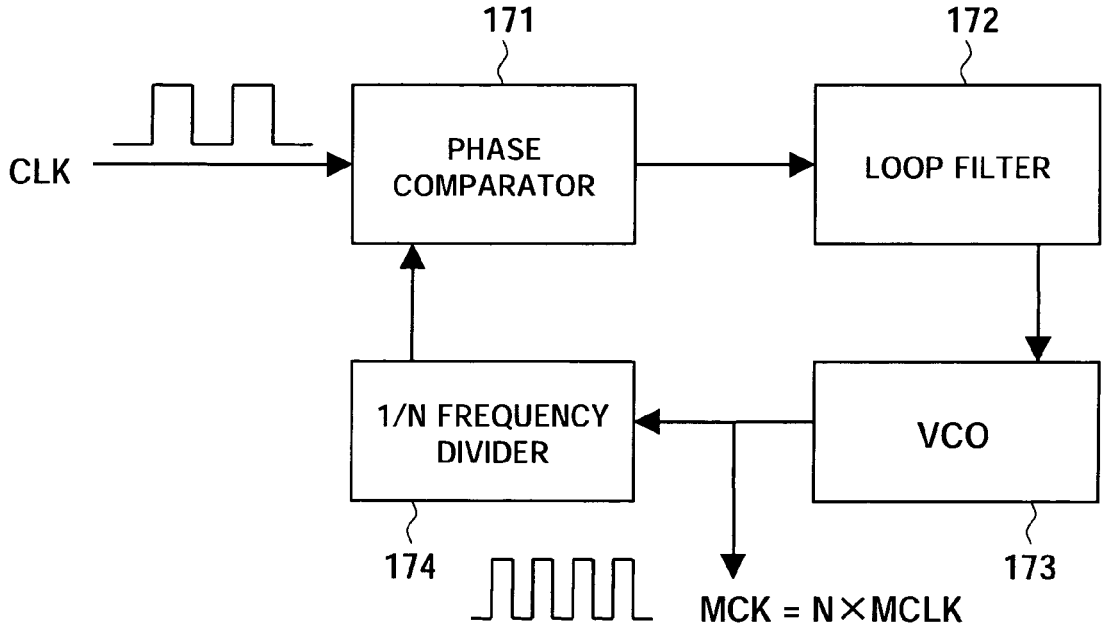
FIG. 2 is part of a block diagram of a phase locked loop (PLL) circuit 17.

The PLL circuit 17 supplies a horizontal synchronization signal HSYNC and a vertical synchronization signal VSYNC given by the synchronous separation from the input analog video signals to the timing generator 16 and, at the same time, generates the master clock MCK used in the LCD based on an external clock CLK and supplies the same to the timing generator 16. The PLL circuit 17 generates the master clock MCK of a frequency of a whole multiple of the external clock CLK. The configuration of the PLL, as shown in FIG. 2, includes a phase comparator 171, a loop filter 172, a 1/N frequency divider 174 and a voltage control oscillator (VCO) 173. As the master clock MCK, any master clock MCK may be generated by the PLL based on the horizontal synchronization signal HSYNC and the vertical synchronization signal VSYNC.

The timing generator 16 generates various types of timing signals such as the master clock MCK, the horizontal clock pulse HCK, and the horizontal start pulse HST based on the master clock MCK, the horizontal synchronization signal HSYNC, and the vertical synchronization signal VSYNC given from the PLL circuit 17.

The horizontal clock pulse HCK, the horizontal start pulse HST, and the master clock MCK generated at the timing generator 16 are commonly given to the R, G, and B LCD panels 11R, 11G, and 11B. The timing generator 16 further also generates pulse width control clock pulses DCK (1, 2) for every R, G, and B mentioned later. These pulse width control clock pulses DCK are separately given to the corresponding LCD panels 11R, 11G, and 11B.

The LCD driver 12 performs amplification processing, 1H (H is a horizontal scanning period) inverse processing, and sample/hold processing, etc. on the R, G, and B analog video signals supplied from the D/A converter 13, then gives them to the LCD panels 11R, 11G, and 11B and drives the display. Here, at the sample/hold processing at the LCD driver 12, in order to simultaneously write video signals by a plurality of pixels at a time, for example six pixels at a time, in the LCD panels 11R, 11G, and 11B, processing for parallel arranging analog video signals sequentially input in a time sequence in units of six pixels is carried out in parallel. Note that, in this parallel arrangement, as the sample/hold pulse thereof, for example a pulse width control clock pulse DCK is used.

A detailed explanation will be given later about functions of the decoders 18R, 18G, and 18B, the delay counters 19R, 19G, and 19B, and the edge detection circuit 20 in the drive IC 21 and the function and concrete configuration of the internal portion of the timing generator 16 accompanied with them.

Here, the decoders 18R, 18G, and 18B, the delay counters 19R, 19G, and 19B, and the edge detection circuit 20 configure the detecting unit for detecting the amount of phase deviation (amount of delay) after the write signals with respect to the video signals written into the pixels 31, that is, the switch pulses SPLS1, SPLS2, . . . pass through the LCD panels 11R, 11G, and 11B.

Further, part of the internal circuit of the timing generator 16 forms the timing adjustment unit for adjusting the timing of the switch pulses SPLS1, SPLS2, . . . , specifically the timing adjustment of the pulse width control clock pulses DCK for generating the switch pulses SPLS1, SPLS2, . . . , by the feedback processing so that the amount of phase deviation becomes almost zero based on this detected amount of phase deviation.

Figure 3:
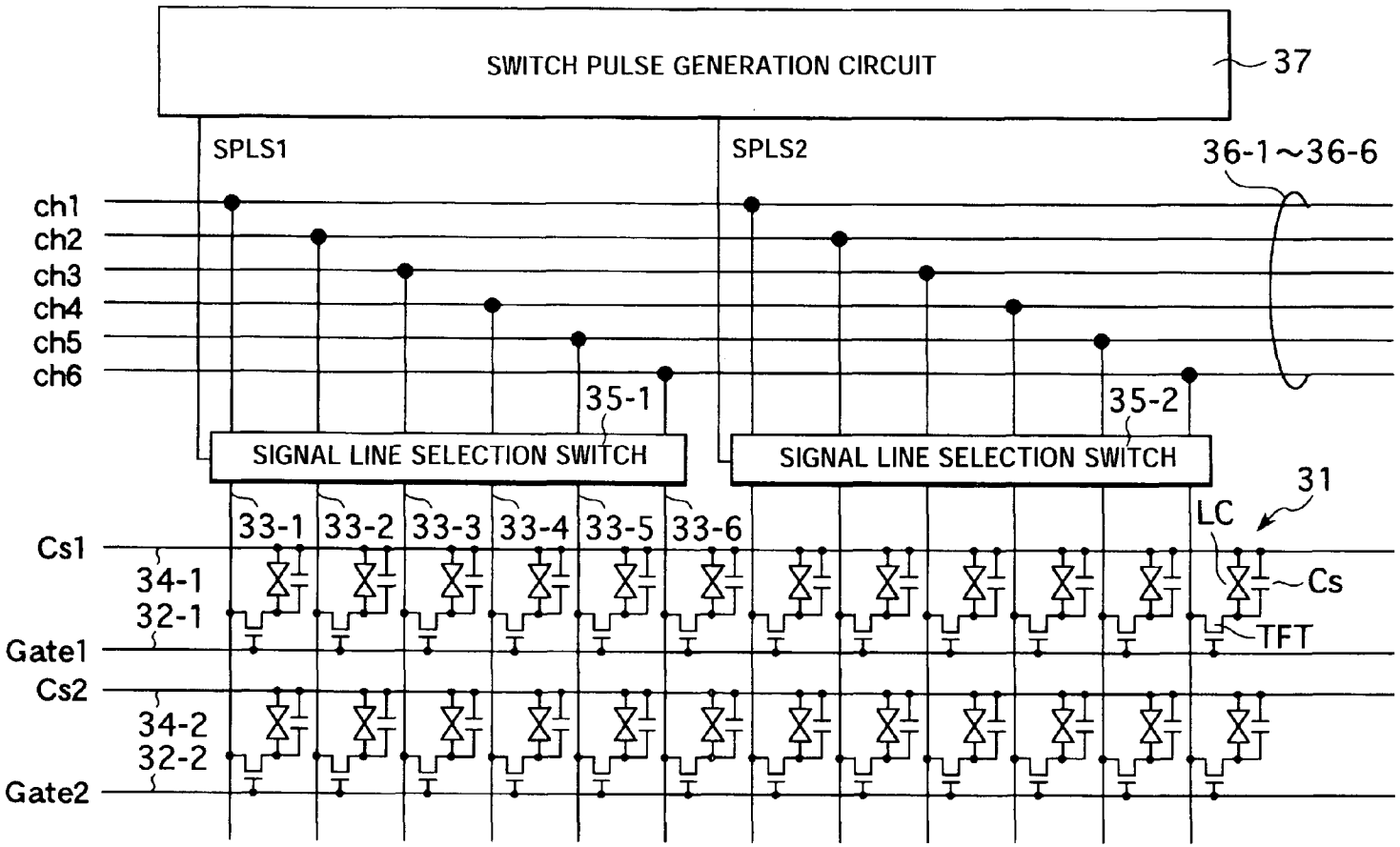
FIG. 3 is a circuit diagram of an example of the configuration of an internal portion of the LCD panel.

FIG. 3 is a circuit diagram of an example of the configuration of the internal portion of an LCD panel 11 (11R, 11G, 11B). In FIG. 3, a display area (display unit) has pixel transistors constituted by thin film transistors TFT, liquid crystal cells LC, and unit pixels 31 having storage capacitances Cs arrayed in a matrix. With respect to this matrix pixel array, vertical scanning lines 32-1, 32-2, . . . are laid for each pixel row, and signal lines 33-1, 33-2, 33-3, . . . are laid for each pixel column.

In this pixel structure, the thin film transistors TFT have gate electrodes connected to vertical scanning lines 32-1, 32-2, . . . and have source electrodes connected to the signal lines 33-1, 33-2, 33-3, . . . . The liquid crystal cells LC have pixel electrodes connected to the drain electrodes of the thin film transistors TFT and have counter electrodes connected to common lines 34-1, 34-2, . . . . Here, the liquid crystal cells LC mean capacitances generated between the pixel electrodes formed by the thin film transistors TFT and the counter electrodes formed facing them. The storage capacitances Cs are connected between the drain electrodes of the thin film transistors TFT and the common lines 34-1, 34-2, . . . .

In the LCD according to the present embodiment, as an example, a six-pixel simultaneous write system for simultaneously writing video signals by six pixels at a time is employed. Therefore, signal line selection switches 35-1, 35-2, . . . are arranged for each six signal lines of the signal lines 33-1, 33-2, 33-3, . . . . Then, six output ends of these signal line selection switches 35-1, 35-2, . . . are connected to first ends of the signal lines 33-1, 33-2, 33-3, . . . .

Further, the six input ends of each of the signal line electrode switches 35-1, 35-2, . . . are connected to the six data lines 36-1 to 36-6. Then, video signals ch1 to ch6 which were parallel arranged for each six pixels at the sample/hold processing in the LCD driver 12 are input through these data lines 36-1 to 36-6, as previously mentioned, to the six input ends of the signal selection switches 35-1, 35-2, . . . .

The signal line selection switches 35-1, 35-2, . . . are given switch pulses SPLS1, SPLS2, . . . from the switch pulse generation circuit 37 as the write signals for writing the video signals into the pixels 31. By this, the six parallel arranged video signals ch1 to ch6 input through the data lines 36-1 to 36-6 are written into the signal lines 33-1, 33-2, . . . via the signal line selection switches 35-1, 35-2, . . . . Then, with respect to the liquid crystal cells LC and the storage capacitances Cs of the pixels 31 connected to the vertical scanning lines 32-1, 32-2, . . . of the rows selectively driven by gate selection pulses (vertical scanning pulses) Gate 1, Gate2, . . . , the video signals are simultaneously written in units of six pixels.

Figure 4:
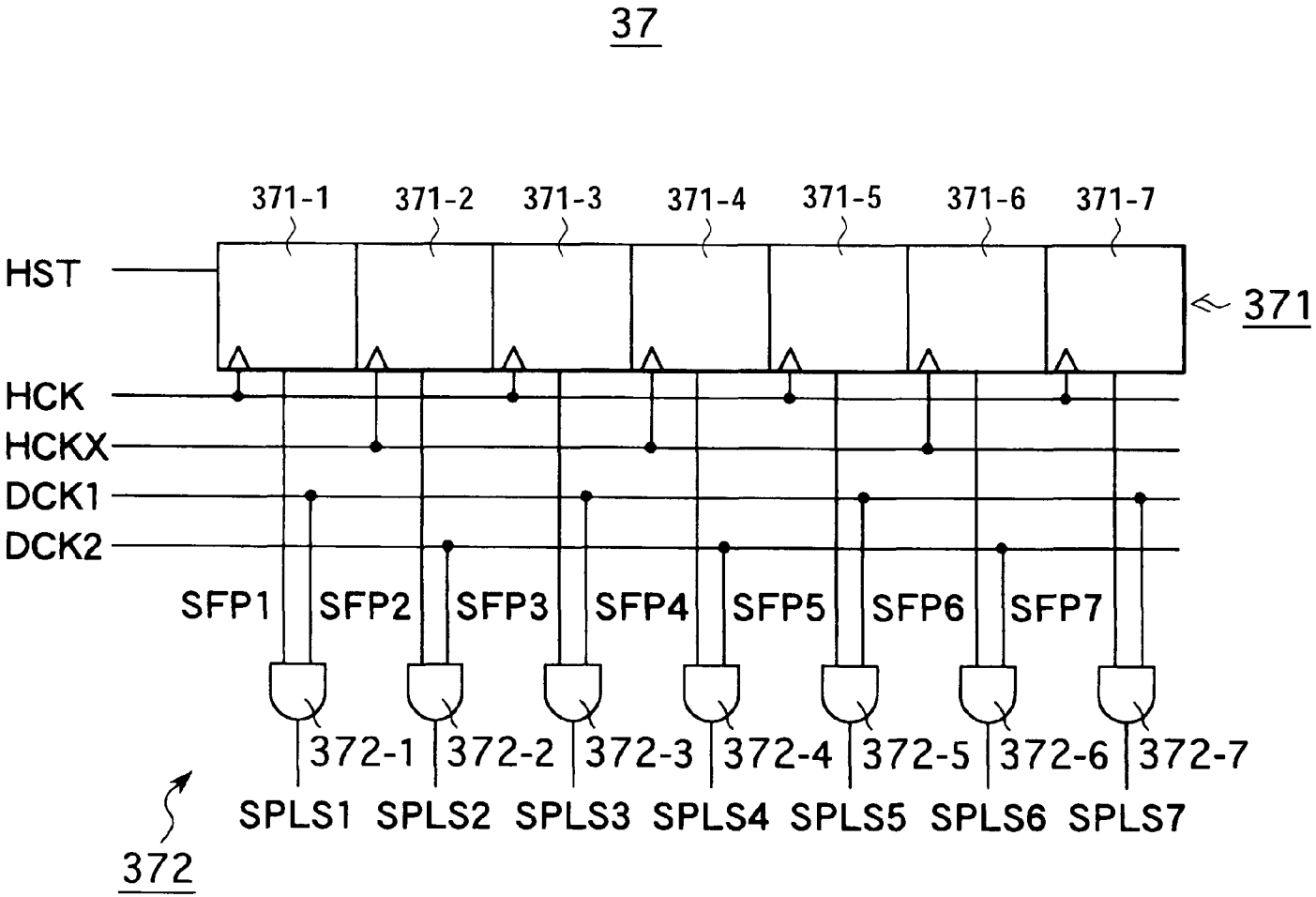
FIG. 4 is a block diagram of an example of the configuration of a switch pulse generation circuit.

FIG. 4 is a block diagram of an example of the configuration of the switch pulse generation circuit 37. As apparent from the diagram, the switch pulse generation circuit 37 is comprised of a shift register 371 and an AND gate group 372. This switch pulse generation circuit 37 is given the horizontal start pulse HST, the horizontal clock pulse HCK, an inverse pulse HCKX thereof, and the pulse width control clock pulses DCK1 and DCK2 generated by the timing generator 16 (refer to FIG. 1) mentioned above.

Note that, here, for the simplification of the drawing, a transfer stage comprising seven stages (the first shift stage 371-1 to the seventh shift stage 371-7) is shown as the shift register 371 as an example, but in reality, it is used a shift register comprising a number of stages corresponding to the number of pixels in the horizontal direction of the display area in which the pixels 31 are arrayed in a matrix. Namely, when the number of pixels in the horizontal direction is m, use is made of a shift register comprising m number of transfer stages as the shift register 371.

In this switch pulse generation circuit 37, the shift register 371 receives as input the horizontal start pulse HST and, at the same time, the horizontal clock pulses HCK and HCKX are given to transfer stages every other stage. The shift register 371 starts the shift operation when the horizontal start pulse HST is input, sequentially shifts the horizontal start pulses HST in synchronization with the horizontal clock pulses HCK and HCKX, and outputs the same as shift pulses SFPl, SFP2, . . . from the transfer stages.

These shift pulses SFP1, SFP2, . . . become inputs of the AND gates 372-1, 372-2, . . . of the AND gate group 372. As other inputs of these AND gates 372-1, 372-2, . . . , pulse width control clock pulses DCK1 and DCK2 are alternately given. The AND gates 372-1, 372-2, . . . take the AND logic between the shift pulses SFP1, SFP2, . . . and the pulse width control clock pulses DCK1 and DCK2 to generate the switch pulses SPLS1, SPLS2, . . . , and supplies the same to the signal line selection switches 35-1, 35-2, . . . of FIG. 3.

FIG. 5 is a timing chart showing the operation of the switch pulse generation circuit 37. (A) shows the master clock MCK, (B) shows the horizontal start pulse HST, (C) shows the horizontal clock pulse HCK, (D) shows HCKX, (E) to (K) show shift pulses SFP1 to SFP7, (L) shows the pulse width control clock pulse DCK1, (M) shows the pulse width control clock pulse DCK2, and (N) to (T) show the switch pulses SPLS1 to SPLS7.

An explanation will be given below for the timing chart shown in FIG. 5 in relation to the switch pulse generation circuit 37 shown in FIG. 4. First, when the horizontal start pulse HST is supplied to the first shift stage 371-1, as shown in FIG. 5(E), a shift pulse SFP1 having the same pulse width as the period of the horizontal clock pulse HCK is output to the AND gate 372-1 in synchronization with the horizontal clock pulse HCK. Then, as shown in FIG. 5(N), the switch pulse SPLS1 of the AND output between the output thereof and the pulse width control clock pulse DCK1 becomes the logic "0".

Figures 5A, 5B, 5C, 5D, 5E, 5F, 5G, 5H, 5I, 5J, 5K, 5L, 5M, 5N, 5O, 5P, 5Q, 5R, 5S, 5T:
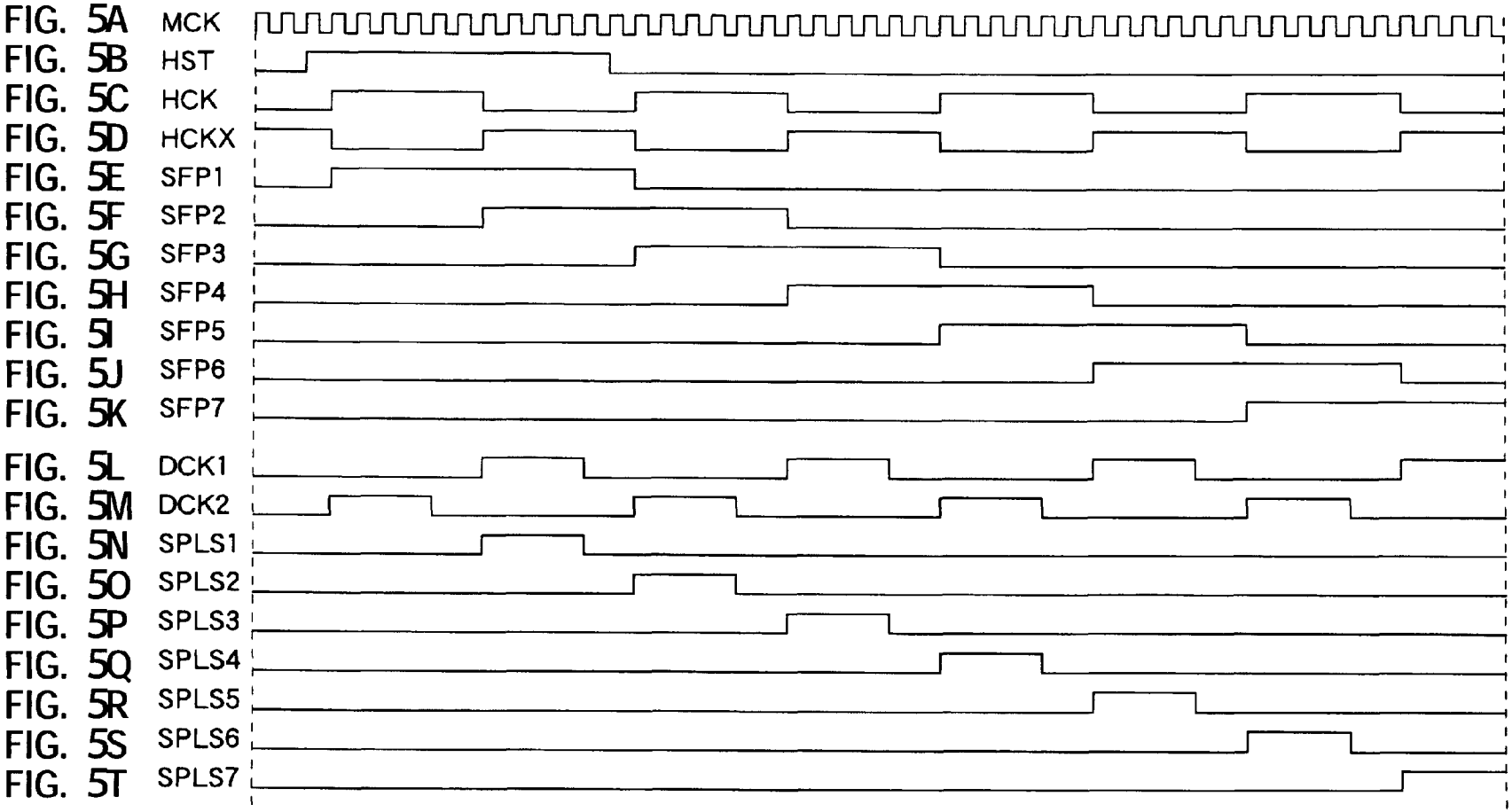
FIG. 5 is a timing chart showing timing relationships of a master clock MCK, a horizontal start pulse HST, horizontal clock pulses HCK and HCKX, shift pulses SFP1, SFP2, . . . , pulse width control clock pulses DCK1 and DCK2, and switch pulses SPLS1, SPLS2, . . .

Next, the shift pulse SFPl is shifted into the second shift stage 371-2, and, as shown in FIG. 5(F), the shift pulse SFP2 having the same pulse width as the cycle of the shift pulse SFP1 is output to the AND gate 372-2 in synchronization with the horizontal clock pulse HCKX. Then, as shown in FIG. 5(N), the switch pulse SPLS12 of the AND output between the output thereof and the pulse width control clock pulse DCK2 becomes the logic "0". At the timing when the second shift stage 371-2 outputs the shift pulse SFP2 to the AND gate 372-2, in the first shift stage 371-1, the pulse width control clock pulse DCK1 becomes the "H" level, so the switch pulse SPLS1 becomes the logic "1". The same operation is performed also for the third shift stage 371-3 and the following stages. Consequently, as shown in (N) to (T) of FIG. 5, the switch pulses SPLS1 to SPLS7 having the same pulse widths as those of the pulse width control clock pulses DCK1 and DCK2 are sequentially output.

As clear from this timing chart, the pulse width control clock pulses DCK1 and DCK2 are pulse signals having pulse widths shifted in phases by exactly a ½ period and narrower than a ½ period. When generating switch pulses SPLS1, SPLS2, . . . , the action is performed of controlling the pulse widths of these switch pulses SPLS1, SPLS2, . . . so that the switch pulses SPLS1, SPLS2, . . . are not superimposed on each other by imparting an appropriate interval between a falling edge of a front pulse and a rising edge of a rear pulse.

In the LCD panels 11R, 11G, and 11B, shift pulses SFPm (shift pulse SFP7 in the present example) output from the last transfer stage m of the shift register 371 are output from the LCD panels 11R, 11G, and 11B as scan pulses R_SOUT, G_SOUT, and B_SOUT. These scan pulses R_SOUT, G_SOUT, and B_SOUT are supplied to the edge detection circuit 20 (refer to FIG. 1) in the drive IC 20.

Here, when circuit elements such as transistors configuring the shift register 371 deteriorate due to a temperature change or aging, a delay occurs in the timing of the output of the scan pulses R_SOUT, G_SOUT, and B_SOUT from the last transfer stage m of the shift register 371 due to this. The deterioration of the circuit elements varies for each of the LCD panels 11R, 11G, and 11B, therefore, the amounts of delay of the scan pulses R_SOUT, G_SOUT, and B_SOUT have different values for the LCD panels 11R, 11G, and 11B.

Referring to FIG. 1 again, the edge detection circuit 20 detects at least one edges of the rising edges or the falling edges for the pulse signals serving as references of the switch pulses SPLS1, SPLS2, . . . as the write signals of the video signals into pixels, that is, the scan pulses R_SOUT, G_SOUT, and B_SOUT. Assume that the edge detection circuit 20 according to the present example detects the both of the rising edges and the falling edges of the scan pulses R_SOUT, G_SOUT, and B_SOUT.

FIG. 6 is a timing chart showing the operation for finding the amounts of delay of the scan pulses, in which (A) shows the master clock MCK, (B) shows horizontal position data HPC_OUT mentioned later, (C) shows a scan pulse SOUT(0) in the initial state, (D) shows a detection pulse at the time of detection of the rising edge(DFT_MODE=0), (E) shows a detection pulse at the time of detection of the falling edge (DFT_MODE=1), (F) shows a delay counter at the time of the rising reference (DFT_MODE=0), (G) shows a delay counter at the time of the falling reference (DFT_MODE=1), (H) shows a scan pulse SOUT(t) when deviation due to aging deterioration etc. occurs, (I) shows the detection pulse at the time of detection of the rising edge based on the scan pulse SOUT(t), and (J) shows the detection pulse at the time of detection of the falling edge based on the scan pulse SOUT(t). Further, FIG. 6 represents scan pulses R_SOUT, G_SOUT, and B_SOUT as scan pulses SOUT(0) and SOUT(t).

As shown in (D) and (E) of FIG. 6, the edge detection circuit 20 generates detection pulses having the pulse width of for example the one cycle of the master clock MCK by detecting the rising edges and the falling edges of the scan pulses R_SOUT, G_SOUT, and B_SOUT. Note that the edge detection circuit 20 does not always output both detection pulses, but outputs the detection pulse of the rising edge when the mode signal has for example the logic "0", while outputs the detection pulse of the falling edge when the mode signal has the logic "1" in accordance with the mode signal DFT_MODE given from a CPU (not illustrated) controlling for example the entire system.

Namely, the edge detection circuit 20 is comprised to select either of the rising edge and the falling edge for each of the scan pulses R_SOUT, G_SOUT, and B_SOUT in accordance with the mode signal DFT_MODE and output the detection pulse when one edge thereof is detected. The detection pulses are given as decode pulses for instructing the decoding of the decoders 18R, 18G, and 18B for decoding the counts of the delay counters 19R, 19G, and 19B.

The delay counters 19R, 19G, and 19B are provided in order to find the amounts of time lag (amounts of delay) of the scan pulses R_SOUT, G_SOUT, and B_SOUT mentioned before. Specifically, the delay counters 19R, 19G, and 19B find the amounts of delay by counting the horizontal position data HPC_OUT mentioned later output from the timing generator 16.

Here, as apparent from FIG. 6, the amount of delay is calculated from the precision of the master clock MCK, therefore, when the frequency of the master clock MCK supplied by the PLL circuit 17 to the timing generator 16 is increased by the setting of the PLL circuit 17 shown in FIG. 2, the precision of the amount of delay can be improved. Accordingly, the configuration can be made so that the frequency of the master clock MCK can be flexibly set in accordance with the processing capability of the LCD in the present embodiment and the precision target value.

The delay counters 19R, 19G, and l9B are given reset data HPC_DAT for setting reset positions (timings) of the counters from for example the above CPU for every R, G, B. Accordingly, by changing the values of the reset data HPC_DAT, the reset positions of the delay counters 19R, 19G, and 19B can be freely set. For example, as shown in (F) and (G) of FIG. 6, by setting the decode pulse positions of the decoders 18R, 18G, and 18B in the initial state at the reset positions of the delay counters 19R, 19G, and 19B, the counts of the delay counters 19R, 19G and 19B become the amounts of delay as they are.

Here, when the PLL circuit 17 increases the frequency of the master clock MCK supplied to the timing generator 16, it is necessary to link it with the frequency of the master clock MCK increasing the precision (resolution) of the reset data HPC_DAT given to the delay counters 19R, 19G, and 19B.

The counts of the delay counters 19R, 19G, and 19B are decoded to the amounts of delay GDFT (R_GDFT, G_GDFT, B_GDFT) of R, G, B at the decoders 18R, 18G, and 18B and supplied to the timing generator 16. The timing generator 16 generates various timing signals as mentioned above, but, here, an explanation will be given of the concrete configuration of the circuit for generating the horizontal clock pulse HCK and the pulse width control clock DCK.

Figure 7:
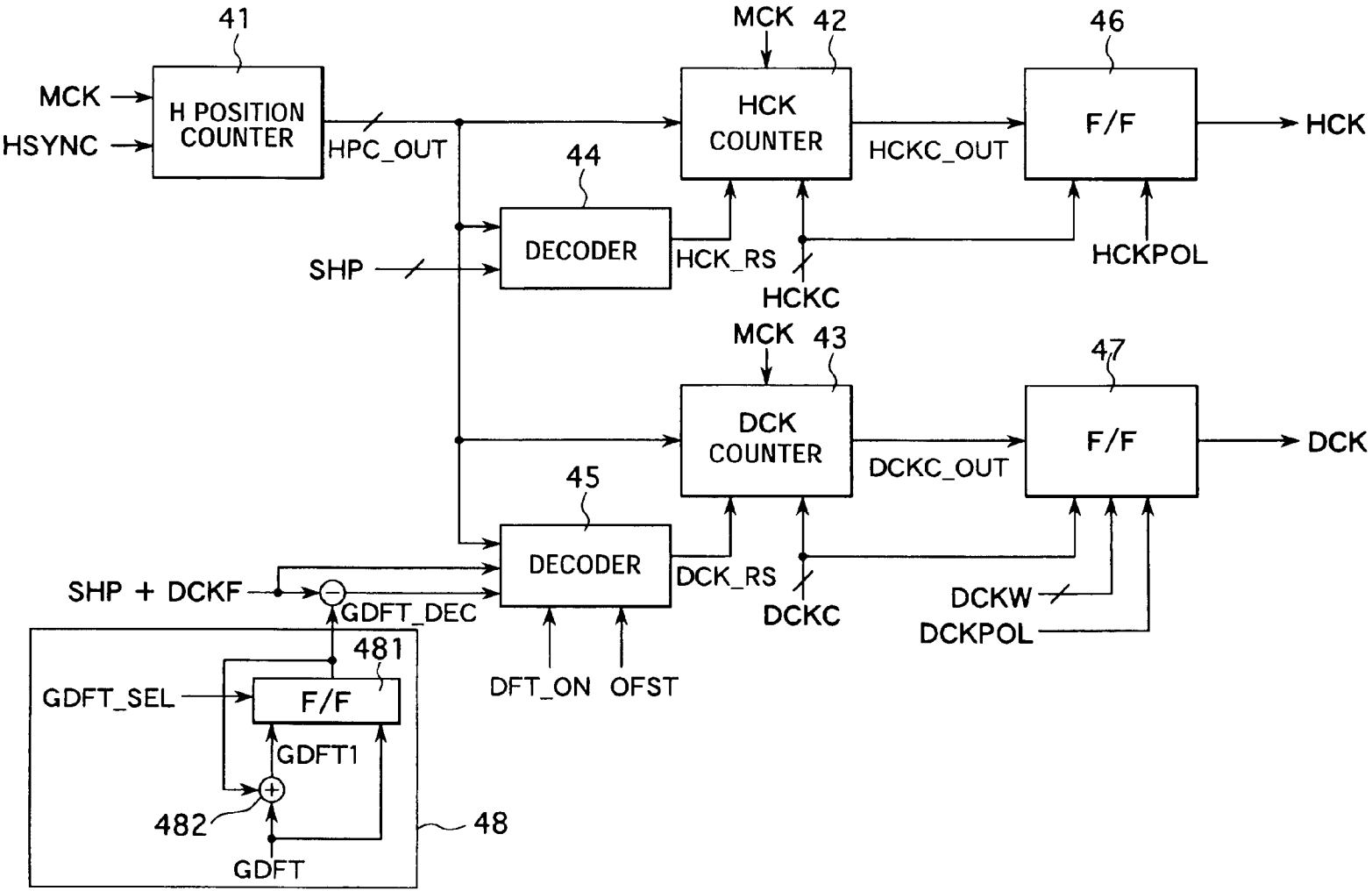
FIG. 7 is a block diagram of an example of the configuration of an HCK and DCK pulse generation circuit.

FIG. 7 is a block diagram of an example of the configuration of the circuit for generating the horizontal clock pulse HCK and the pulse width control clock pulse DCK (hereinafter simply referred to as the "HCK and DCK pulse generation circuit"). This HCK and DCK pulse generation circuit comprises the controlling means for adjusting the timing of the pulse width control clock pulse DCK by the feedback processing so that the amount of delay becomes almost zero based on the amount of delay (amount of phase deviation) GDFT detected at the drive IC 20 and provided corresponding to the R, G, and B LCD panels 11R, 11G, and 11B (refer to FIG. 1).

As apparent from FIG. 7, the HCK and DCK pulse generation circuit is comprised of an H (horizontal direction) position counter 41, an HCK counter 42, a DCK counter 43, decoders 44 and 45, flip-flops (F/F) 46 and 47, and a feedback processing block 48.

The H position counter 41 is reset by the horizontal synchronization signal HSYNC, then is incremented in the count in synchronization with the master clock MC. It outputs the count for every 1H (H is the horizontal scanning period) as the horizontal position data HPC_OUT indicating the position in the horizontal direction. The horizontal position data HPC_OUT is given to the HCK counter 42, the DCK counter 43, and the decoders 44 and 45.

The decoder 44 generates a reset pulse HCK_RS which becomes the high level (hereinafter described as the "H" level) only when the value of the horizontal position data HPC_OUT is the register value SHP. Here, the register value SHP is for determining the start position of the horizontal clock pulse HCK in 1H. The reset pulse HCK_RS is given to the HCK counter 42.

The HCK counter 42 is reset by the reset pulse HCK_RS, then is incremented in count in synchronization with the master clock MCK. When the count HCKC_OUT thereof is the register value HCKC, the HCK counter 42 is reset again. Here, the register value HCKC is for setting the period of the horizontal clock pulse HCK. The count HCKC_OUT of the HCK counter 42 is given to the flip-flop 46.

The flip-flop 46 outputs the polarity set by a polarity setting HCKPOL. By inverting the polarity of the polarity setting HCKPOL for every half period {(HCKC+1}/2}, it generates a pulse of a 50% duty ratio. Due to this, the horizontal clock pulse HCK of the output pulse of the flip-flop 46 becomes a clock pulse having a 50% duty ratio by the period (HCKC+1) using the position of the reset pulse HCK_RS generated at the decoder 44 as a reference.

The decoder 45 decodes the value of the horizontal position data HPC_OUT of the output of the H position counter 41 to generate the reset pulse DCK_RS of the DCK counter 43. The DCK counter 43 is reset by the reset pulse DCK_RS, then is incremented in count in synchronization with the master clock MCK. When the count DCKC_OUT is the register value DCKC, the DCK counter 42 is reset again. Here, the register value DCKC is for setting the period of the pulse width control clock pulse DCK. The count DCKC_OUT of the DCK counter 43 is given to the flip-flop 47.

The flip-flop 47 outputs the polarity set by the polarity setting DCKPOL. When the count DCKC_OUT is the register value DCKW, it inverts the polarity of the polarity setting DCKPOL to hold that value. When the count DCKC_OUT is the register value DCKW thereafter, the polarity setting DCKPOL is set again, thereby to generate a pulse having a pulse width (DCKW+1) and a period (DCKC+1). At this time, the relationship of DCKW<DCKC is held. Due to this, the pulse width control clock pulse DCK of the output pulse of the flip-flop 47 becomes the clock pulse of the period (DCKC+1) and the pulse width (DCKW+1) by using the position of the reset pulse DCK_RS generated at the decoder 45 as a reference.

The decoder 45 is given a register value DFT_ON for turning a drift processing explained later on/off and a register value OFST indicating the offset value mentioned later. Here, the drift processing is turned off when the register value DFT_ON has the logic "0", and the drift processing is turned on when the register value DFT_ON has the logic "1". The decoder 45 generates a reset pulse DCK_RS which becomes the "H" level only when the value of the horizontal position data HPC_OUT is (SHP+DCKF) when the drift processing is off. Here, the register value DCKF is for setting the phase difference of the pulse width control clock pulse DCK with respect to the horizontal clock pulse HCK.

The decoder 45 generates the reset pulse DCK_RS which becomes the "H" level only when the value of the horizontal position data HPC_OUT is (SHP+DCKF_DCKF_DEC+OFST) when the drift processing is on. Here, the DCKF_DEC is the output value of the feedback processing block 48. Further, the register value OFST becomes valid when the register value DFT_ON has the logic "1", that is, the drift processing is on.

This is for imparting an offset value given as the register value OFST so that the reset position does not take a value before the value 000 h of the horizontal position data HPC_OUT by the feedback processing mentioned later. In this way, when performing the feedback processing, by adding the offset to the reset position of the pulse width control clock pulse DCK to be fed back in advance, the reset can be reliably performed.

Next, an explanation will be given of the feedback processing block 48. As apparent from FIG. 7, the feedback processing block 48 is comprised of a flip-flop 481 and an adder 482. This feedback processing block 48 receives as input amounts of delay GDFT (R_GDFT, G_GDFT, and B_GDFT) from the R, G, and B LCD panels 11R, 11G, and 11B (refer to FIG. 1).

The scan pulses GDFT (R_GDFT, G_GDFT, and B_GDFT) output from the LCD panels 11R, 11G, and 11B sometimes do not move forward in position on the time axis along with the feedback processing and sometimes do move. Accordingly, the feedback processing block 48 performs different processings between the case where the scan pulse GDFT does not move in the forward direction on the time axis and the case where it moves in the forward direction. Here, the "feedback processing" means that the amount of delay GDFT obtained based on the scan pulse GDFT is reflected in the reset position of the DCK counter 43.

The scan pulse GDFT does not move in the forward direction in the case of specifications where the shift registers 37 (refer to FIG. 4) in the LCD panels 11R, 11G, and 11B perform the shift operation in synchronization with the horizontal clock pulse HCK as in the case of an LCD according to the present embodiment. In this case, the register value GDFT_SEL is set at the logic "0". In the case of an LCD panel of these specifications, as apparent from the previous explanation, use is also made of the pulse width control clock pulse DCK. On the other hand, the scan pulse GDFT moves in the forward direction in the case of specifications where the shift registers 37 perform the shift operation in synchronization with the pulse width control clock pulses DCK. In this case, the register value GDFT_SEL is set at the logic "1". In the case of an LCD panel of these specifications, the horizontal clock pulse HCK is not used.

When the scan pulse GDFT does not move in the forward direction, the values decoded by the decoders 11R, 11G, and 11B become the amounts of delay as they are. Therefore, by the flip-flop 481 given the register value GDFT_SEL of the logic "0", the amounts of delay GDFT supplied from the decoders 11R, 11G, and 11B are defined as the output values DCKF_DEC of the feedback processing block 48 as they are.

Here, after decoding them at the decoders 11R, 11G, and 11B at first, when the feedback processing is carried out based on the amounts of delay GDFT thereof, the values to be decoded by the decoders 11R, 11G, and 11B next become "0", while when the same processing as that in the case where the scan pulse GDFT does not move in the forward direction is carried out, it returns to the state after the feedback processing was carried out or the state before the feedback processing.

Accordingly, when the scan pulse GDFT moves in the forward direction, by holding the amounts of delay GDFT obtained by decoding at the decoders 11R, 11G, and 11B at first in the flip-flop 481 and adding the held GDFT with the next amount of delay at the adder 482, the amount of delay GDFT1 from the initial stage is found. This amount of delay GDFT 1 is defined as the output value DCKF_DEC of the feedback processing block 48.

The function of the feedback processing block 48 explained above is summarized below. Namely, when feedback is not applied to the scan pulse SOUT per se by the feedback processing, the values GDFT obtained by decoding the counts of the delay counters 19R, 19G, and 19B by the decoders 18R, 18G, and 18B are defined as the feedback amounts as they are, while when feedback is applied to the scan pulse SOUT per se, the value obtained by adding the decode value GDFT to the next decode value is defined as the feedback amount.

Figure 8:
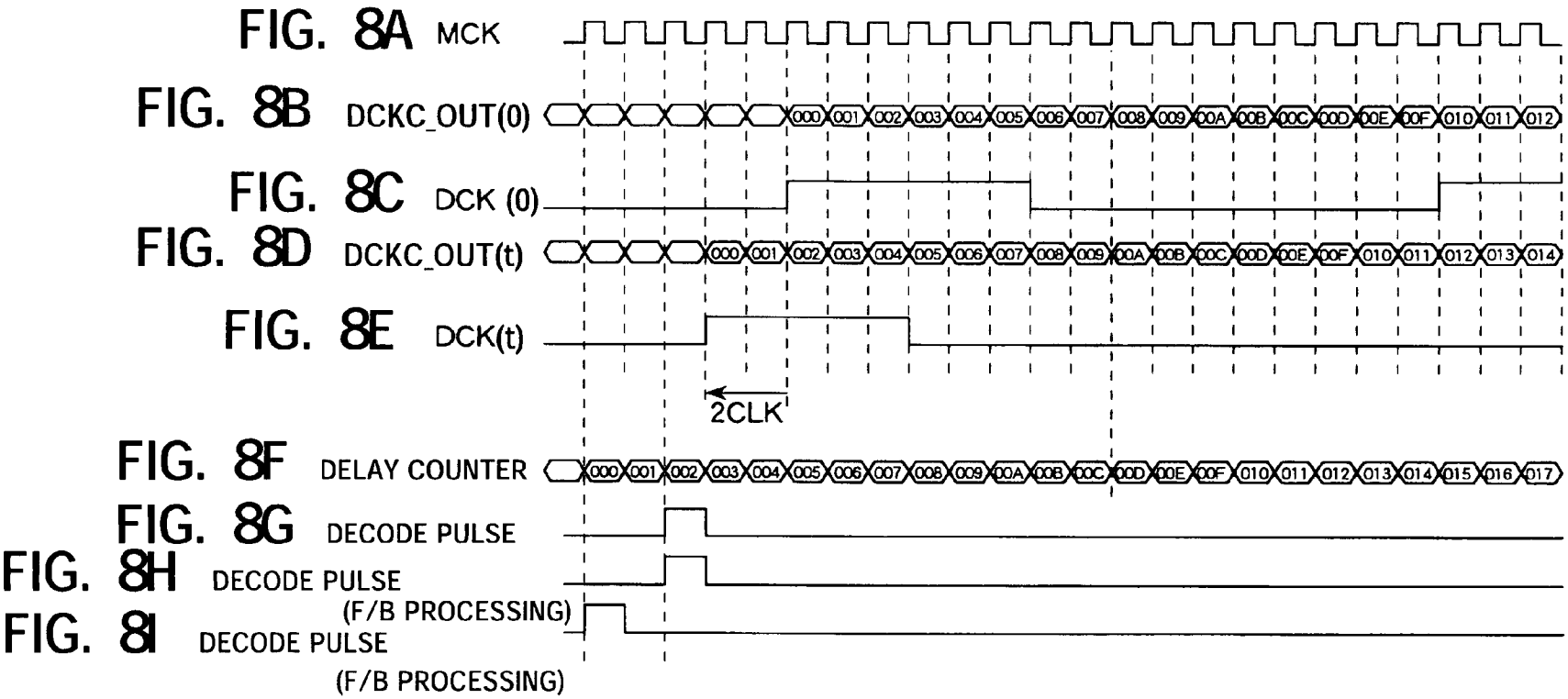
FIG. 8 is a timing chart for explaining the circuit operation of the HCK and DCK pulse generation circuit.

FIG. 8 is a timing chart for explaining the circuit operation of the HCK and DCK pulse generation circuit, in which (A) shows the master clock MCK, (B) shows a count DCKC_OUT(0) of the initial state of the DCK counter 43, (C) shows a pulse width control clock pulse DCK(0) in the initial state, (D) shows the count DCKC_OUT(0) of the DCK counter 43 when deviation occurs due to aging etc., (E) shows a pulse width control clock pulse DCK(t) when deviation occurs due to the aging etc., (F) shows the delay counter, (G) shows the decode pulse before the feedback processing (F/B processing), (H) shows the decode pulse after the F/B processing when F/B processing is not applied to the scan pulse SOUT per se, and (I) shows the decode pulse after the F/B processing when F/B processing is applied to the scan pulse SOUT per se.

As shown in (A) to (E) of FIG. 8, assume that the system is set up so that for example the decode pulse (detection pulse) generated at the edge detection circuit 20 in the initial state becomes 000 h of the delay counters 19R, 19G, and 19B, and a delay of an amount of two clocks (2 CLK) of the master clock MCK occurs in the pulse width control clock pulse DCK due to a temperature change or aging. When the feedback processing is not applied to the scan pulse SOUT per se, even if the feedback processing is carried out, the position of the decode pulse is set at the position of 002 h of the delay counters 19R, 19G, and 19B as shown in (H) of FIG. 8, therefore the shift is made from the reset position in the forward direction by exactly the amount of the count.

When the scan pulse SOUT per se is feedback processed, when the feedback processing is carried out, as shown in (I) FIG. 8, the decode pulse will decode 000 h of the delay counters 19R, 19G, and 19B, therefore the counts decoded from the initial state are added, and the value is shifted in the forward direction from the reset position.

Note that the information of the register values SHP, HCKC, DCKC, DCKW, DFT_ON, OFSST and the polarity settings HCKPOL, DCKPOL, etc. given to the DCK pulse generation circuit is set by the CPU (not illustrated) for control of the entire system.

Next, an explanation will be given of the operation when automatically adjusting the phase of the timing signal for simultaneously writing a plurality of pixels by the feedback processing in the LCD according to the present embodiment having the above configuration.

When driving the R, G, and B LCD panels 11R, 11G, and 11B, scan pulses R_SOUT, G_SOUT, and B_SOUT output from the LCD panels 11R, 11G, and 11B after passing through the shift register 371 in the switch pulse generation circuit 37 are input to the drive IC 21. In the following processing, the processings are separately carried out for the scan pulses R_SOUT, G_SOUT, and B_SOUT, but for simplification, an explanation will be given using the scan pulse SOUT as representative of them.

In the drive IC 21, the edge detection circuit 20 detects the rising and falling edges of the scan pulse SOUT as shown in the timing chart of FIG. 6 and outputs the detection pulses which become the "H" level at the detection timing thereof as the decode pulses. On the other hand, the R, G, and B delay counters 19R, 19G, and 19B count the horizontal position data HPC_OUT given from the H position counter 41 (refer to FIG. 7) in the timing generator 16. The reset timing of these delay counters 19R, 19G, and 19B can be freely set by the R, G, and B reset data HPC_DAT.

Then, the counts of the delay counters 19R, 19G, and 19B are decoded by the R, G, and B decoders 18R, 18G, and 18B using the R, G, and B detection pulses given from the edge detection circuit 20 as a trigger. The decode values of these decoders 18R, 18G, and 18B are amounts of delay (delay time) GDFT (R_GDFT, G_GDFT, B_GDFT) from the optimum states of the scan pulses R_SOUT, G_SOUT, and B_SOUT and given to the feedback processing block 48 (refer to FIG. 7) in the timing generator 16.

Here, the "optimum state" means for example the state where the phase relationships between the timing signals for the simultaneous write operation and the video signals are optimally adjusted in the adjustment stage before shipping the LCD. These phase relationships deviate along with deterioration of the circuit elements such as the transistors due to a temperature change or aging after shipping the LCD. Note that, when finding the amounts of delay GDFT (R_GDFT, G_GDFT, B_GDFT), whether the rising edges of the scan pulses R_SOUT, G_SOUT, and B_SOUT are used as a reference or the falling edges thereof are used as a reference can be freely switched according to the mode signal DFT_MODE given to the edge detection circuit 20. Which of them is optimum may be selected in accordance with the state of the LCD panels 11R, 11G, and 11B.

In the HCK and DCK pulse generation circuit of FIG. 7, the feedback processing for reflecting the amounts of delay GDFT (R_GDFT, B_GDFT, B_GDFT) calculated as mentioned above in the reset position (timing) of the DCK counter 43 is carried out. Specifically, by decoding the horizontal position data HPC_OUT at the decoder 45 by using the amounts of delay GDFT as a reference, the reset pulse DCK_RS of the DCK counter 43 is generated, and the DCK counter 43 is reset. The pulse width control clock pulse DCK generated based on the count of this DCK counter 43 is used as the sample/hold pulse at the parallel arrangement processing in the LCD driver 12 as previously explained.

As mentioned above, in an LCD employing a multi-pixel (six-pixel in the present example) simultaneous write system, by performing the feedback processing for inputting the scan pulses R_SOUT, G_SOUT, and B_SOUT output from the R, G, and B LCD panels 11R, 11G, and 11B to the drive IC21 for supplying various types of timing signals to these LCD panels 11R, 11G, and 11B, measuring the amounts of delay (delay time) GDFT from the optimum states of these scan pulses R_SOUT, G_SOUT, and B_SOUT, and reflecting the amounts of delay in the pulses for sampling/holding the video signals, for example, the pulse width control clock pulses DCK, the phase relationships between various types of timing signals for driving the LCD panels 11R, 11G, and 11B, and the video signals can be automatically adjusted to the optimum state.

Due to this, the deviation of the phase relationships between the timing signals and the video signals induced from the delay occurring in the drive pulses, particularly the switch pulses SPLS1, SPLS2, . . . for simultaneously writing a plurality of pixels, due to deterioration of circuit elements such as transistors due to a temperature change or the aging in the LCD panels 11R, 11G, and 11B is automatically eliminated, and the disturbance of the video signals can be prevented, therefore, it becomes possible to always obtain the optimum display image without the influence of a temperature change or aging.

Especially, the present embodiment is configured so that a master clock MCK of any frequency can be generated in the PLL circuit 17. Therefore, by increasing the frequency of the master clock MCK as much as possible within the range of the capability of the device, it becomes possible to perform the feedback processing for reflecting the amount of delay with a good precision.

Note that, in the above embodiment, the explanation was given assuming an LCD of a type fetching the pulse width control clock pulses DCK 1 and DCK2 from the outside of the panel, but the HCK and DCK pulse generation circuit shown in FIG. 7 is comprised so that the pulse periods and the pulse widths of the pulse width control clock pulses DCK and the clock pulses determining the write timing of the video signals into the pixels 31, that is, the phase difference with respect to the horizontal clock pulse HCK, can be freely set by the register values DCKC, DCKW, and DCKF. Therefore, even in an LCD of a type for generating the pulse width control clock pulses DCK1 and DCK2 inside the panel by using the horizontal clock pulses HCK and HCKX, by inputting the pulse width control clock pulses DCK1 and DCK2 as the horizontal clock pulses HCK and HCKX, the feedback processing can be simultaneously carried out.

Note that, in the above embodiment, the explanation was given by explaining an LCD of the multi-pixel simultaneous write system as an example, but the present invention is not limited to application to the multi-pixel simultaneous write system. It is concerned with the automatic adjustment of the phase relationships between the timing signals for driving the LCD panels, particularly the timing signals for writing the video signals, and the video signals, therefore the present invention can also be applied to a system for writing the video signals in units of pixels in the same way as the above.

Further, in the above embodiment, the case where the present invention was applied to an LCD of a color system having R, G, and B LCD panels 11R, 11G, and 11B was explained as an example, but the present invention is not limited to application to the color system, but can also be applied to an LCD of the monochrome system in the same way as the above. Further, the invention is not limited to application to an LCD, but can be applied to all displays using cathode ray tubes (CRTs) or electroluminescence (EL) elements as displays, particularly all displays employing the method of simultaneously writing the video signals by a plurality of pixels at a time.

[Example of Application]

Further, the signal processing system including the drive IC 20 can be used as a signal processing system of a projection type display, for example a liquid crystal projector, as well. The general configuration of the liquid crystal projector is shown in FIG. 9.

Figure 9:
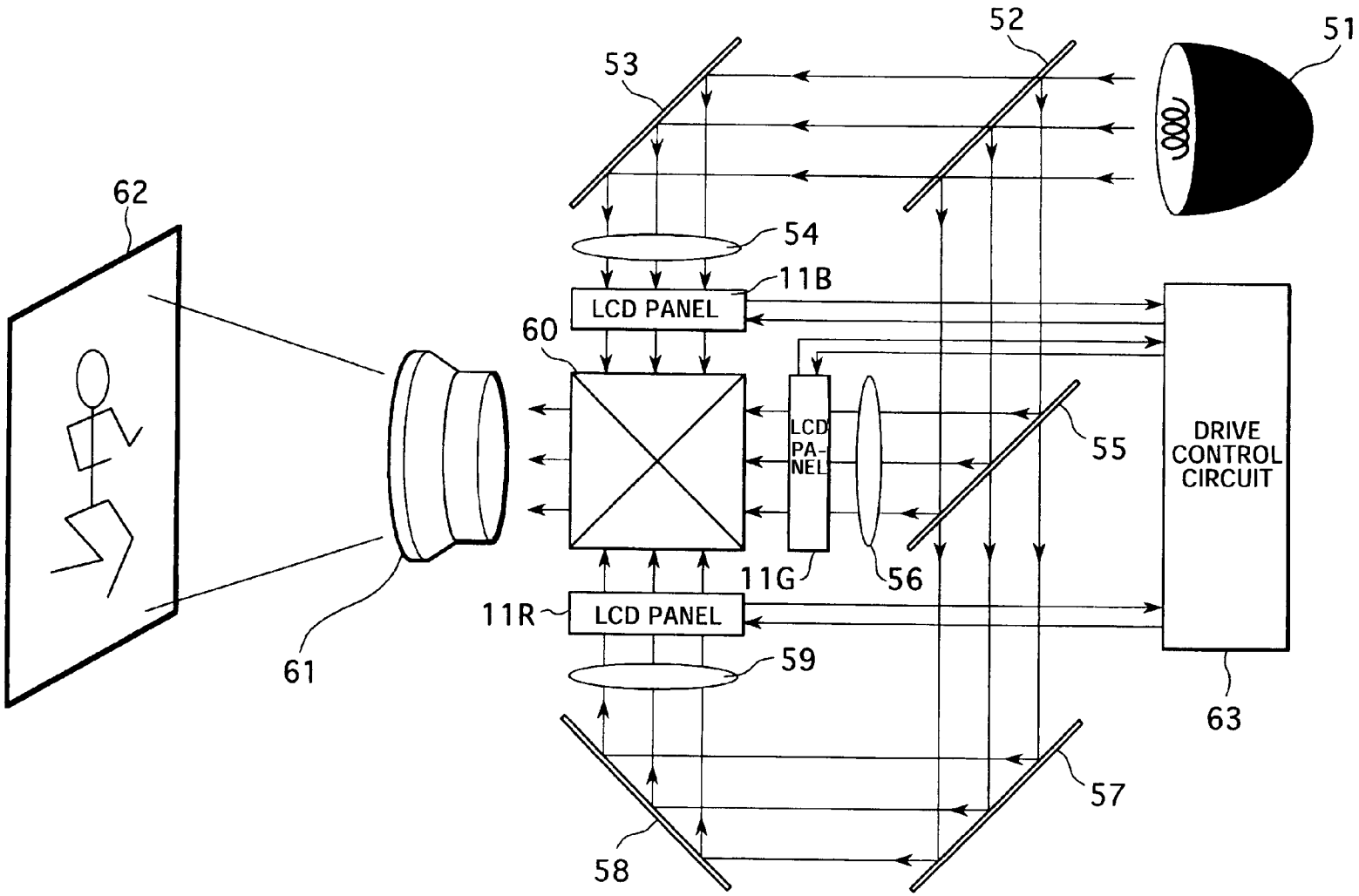
FIG. 9 is a view of the schematic configuration of an example of a liquid crystal projector.

In FIG. 9, only a specific color component, for example a B (blue) optical component having the shortest wavelength, of a white beam emitted from a light source 51 passes through a first beam splitter 52. The optical components of the remaining colors are reflected. The B optical component passed through the first beam splitter 52 is changed in light path at a mirror 53 and irradiated to the LCD panel llB through a lens 54.

Among the optical components reflected at the first beam splitter 52, the for example G (green) optical component is reflected at a second beam splitter 55, and the R (red) optical component passes therethrough. The G optical component reflected at the second beam splitter 55 is irradiated to the G LCD panel 11G through a lens 56. The R optical component passed through the second beam splitter 55 is changed in light path at the mirrors 57 and 58 and irradiated to the R LCD panel 11 through a lens 59.

The R, G, and B lights passed through the LCD panels 11R, 11G, and 11B are coupled at a cross prism 60. The coupled beam emitted from this cross prism 60 is projected onto a screen 62 by a projection prism 61.

In the liquid crystal projector having the above configuration, the LCD panels 11R, 11G, and 11B receive as input the analog video signals processed for R, G, B in parallel at the signal processing system shown in FIG. 1 and arranged in parallel in units of a plurality of pixels, for example, six pixels, at the sample/hold processing at the LCD driver 12.

Further, the LCD panels 11R, 11G, and 11B receive as input various types of drive pulses from the drive control circuit 63. By using the above drive IC 20 as this drive control circuit 63, the disturbance of the video signals can be prevented by automatically eliminating the deviation of the phase relationships between the timing pulses and the video signals induced due to the delay occurring in the drive pulses, particularly the switch pulses for simultaneously writing a plurality of pixels, due to the deterioration of the circuit elements such as the transistors due to a temperature change or aging in the LCD panels 11R, 11G, and 11B, therefore it becomes possible to always obtain the optimum display image without the influence of a temperature change and aging.

Note that, here, the explanation was given by taking as an example the case where the present invention was applied to a liquid crystal projector of the color system, but the present invention can also be applied to a liquid crystal projector of the monochrome system in the same way as above. At this time, naturally one channel's worth of the signal processing system is sufficient.

Second Embodiment

Figure 10:
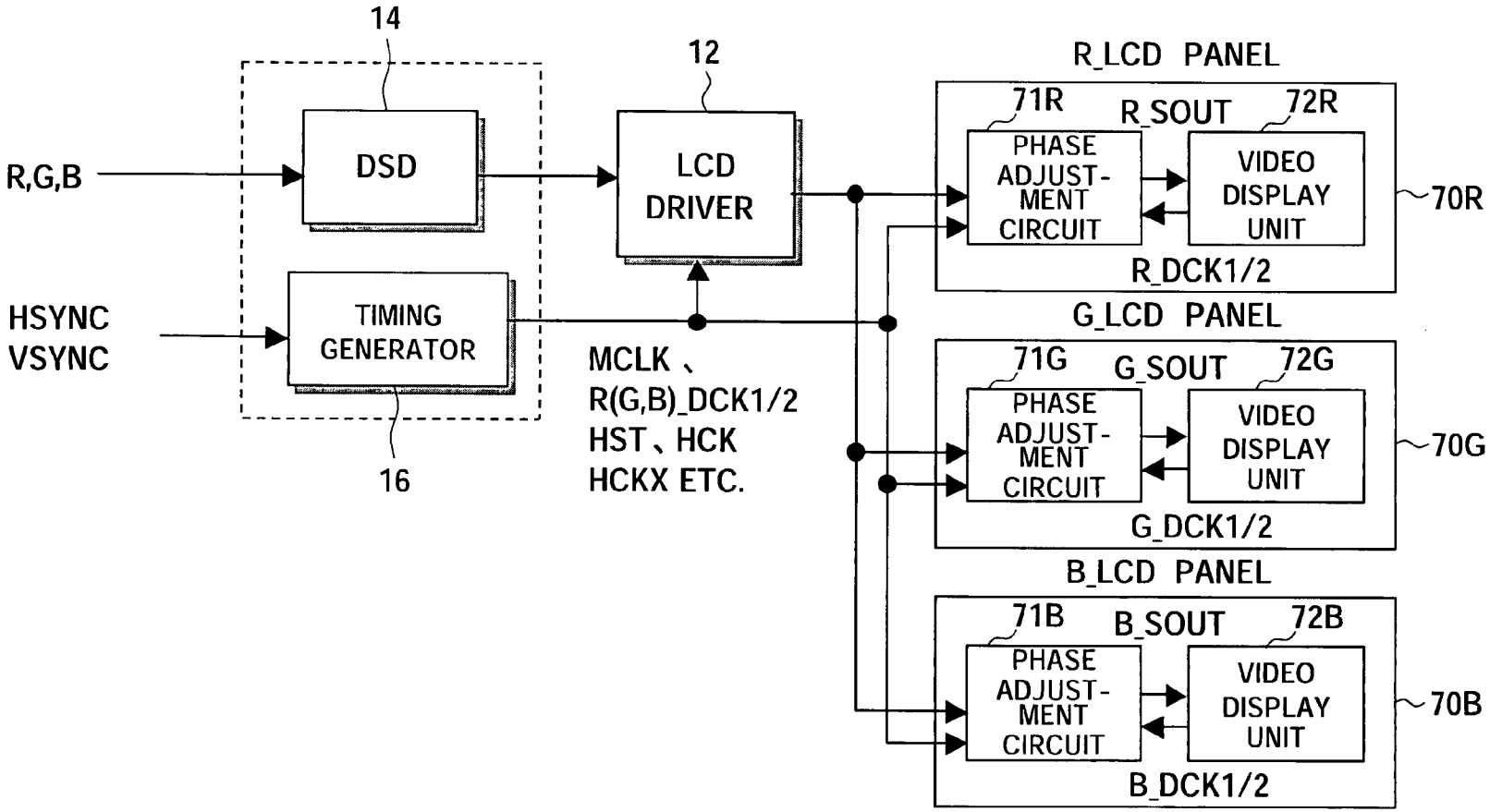
FIG. 10 is a block diagram of the system configuration of an LCD according to a second embodiment of the present invention.

Below, an explanation will be given for a second embodiment of the present invention. FIG. 10 is a block diagram of the system configuration of the LCD of the present embodiment. In FIG. 10, the components assigned the same notations as those of the LCD in the first embodiment shown in FIG. 1 are the same as those of FIG. 1. Accordingly, the LCD driver 12, the DSD 14, and the timing generator 16 are the same as the components shown in FIG. 1. In FIG. 10, the PLL circuit 17 for generating the master clock MCK is omitted, but the precision of the amount of delay can be improved by generating a master clock MCK of any frequency by the same configuration as that of the LCD in the first embodiment.

The characteristic feature of the present embodiment resides in that the LCD panels 70R, 70G, and 70B. These LCD panels include phase adjustment circuits 71R, 71G, and 71B. The phase adjustment circuits 71R, 71G, and 71B can be realized by configuring the edge detection circuit 20, the delay counters 19R, 19G, and 19B, and the decoders 18R, 18G, and 18B shown in FIG. 1 in the first embodiment so that they are independently arranged in the LCD panels 70R, 70G, and 70B. Specifically, by building in and mounting the above circuit group near the output stage of the scan pulse SOUT, the interconnects from the scan pulse SOUT to phase adjustment circuits 71R, 71G, and 71B become the shortest in distance, so it becomes possible to suppress the influence of the distortions of the scan pulses due to the additional capacitances of the interconnects and the noise from the outside to the lowest limit.

Third Embodiment

Below, an explanation will be given for a third embodiment of the present invention. The block diagram of the LCD in the present embodiment is the same as the LCD in the second embodiment. The phase adjustment circuits 71R, 71G, and 71B are configured by the circuits of the block diagram shown in FIG. 11. Each of the phase adjustment circuits in the present embodiment has an inverter 711, a phase detector (PD) 712, a low pass filter (LPF) 713, a voltage control oscillator (VCO) 714, and a phase processing unit 715. The phase detector 712, the low pass filter 713, and the voltage control oscillator 714 configure the phase detector.

In the phase adjustment circuits 71R, 71G, and 71B, by detecting the phases of the SOUT signals (R_SOUT, G_SOUT, B_SOUT) from the video display units by the phase detectors 712 and reflecting the phases deviating due to a temperature change or aging in the pulse width control clock pulses DCK1 and DCK2 at the phase processing unit, the timing of the switch pulses is adjusted. For example, when the scan pulses passed through the video display units 72R, 72G, and 72B gradually change like the scan pulses SOUT1, SOUT2, SOUT3, . . . , the phase detector detects the amount of deviation of phases between SOUT2 and SOUT1 as the pulse and fetches the same into the phase processing unit 715. Further, for the amount of phase deviation between SOUT3 and SOUT2 and the scan pulses following this as well, the phase detection is carried out by the same procedures as described above. The pulses are sequentially fetched into the phase processing unit 715.

In the phase processing unit 715, the phase difference of the initial value between the scan pulse SOUT set at the time of manufacture in advance and the pulse width control clock pulses DCK 1 and 2 is set. Then, by comparing the phase difference of this initial value and the amount of phase deviation fetched from the phase detector, the difference is reflected in the pulse width control clock pulses DCK1 and DCK2 in units of the master clock MCK.

Figure 11:
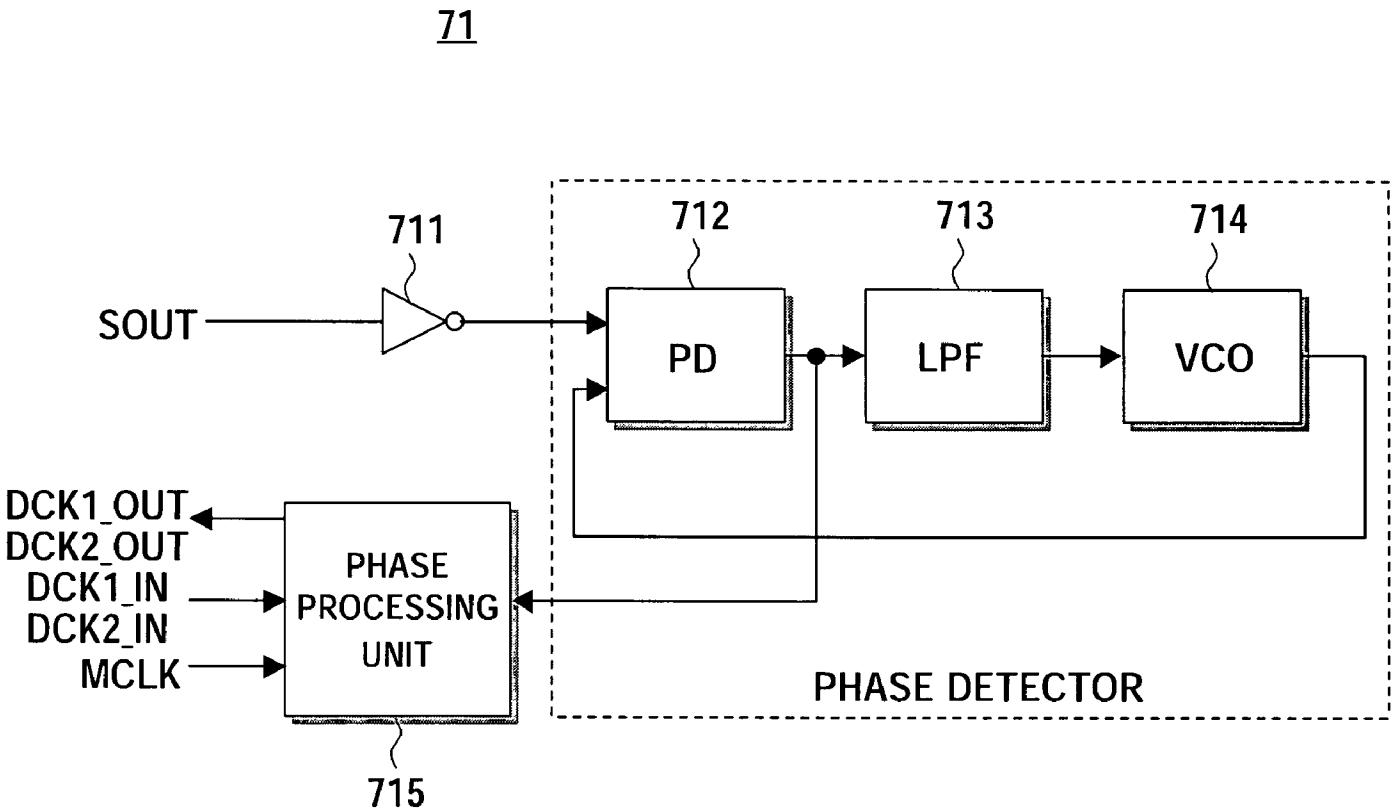
FIG. 11 is a block diagram of a phase adjustment circuit.

In FIG. 11, DCK1_IN and DCK2_IN are pulse width control clock pulses DCK1 and DCK2 input by the phase processing unit 715 before the difference is reflected, and DCK1_OUT and DCK2_OUT are pulse width control clock pulses DCK1 and DCK2 output by the phase processing unit 715 after the difference is reflected.

Figure 12:
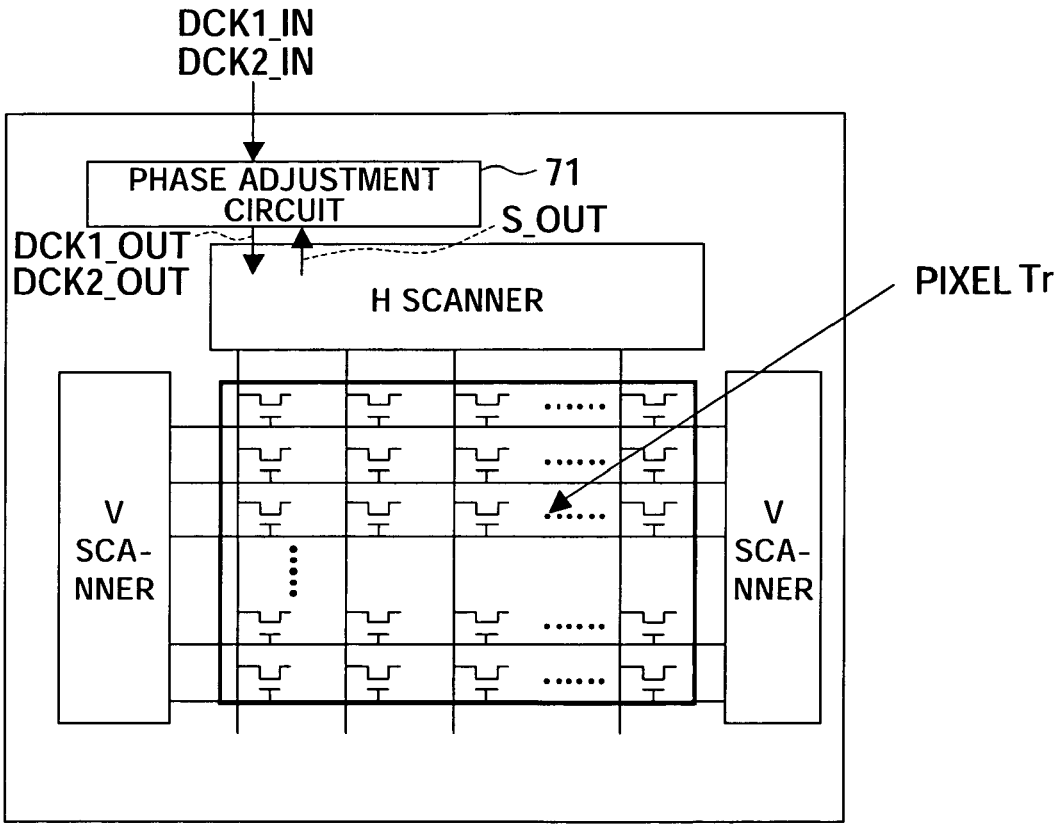
FIG. 12 is a diagram of an example of the layout of a phase adjustment circuit.

FIG. 12 is a view of an example where the phase adjustment circuit 71 is mounted on the glass of the LCD panel. As shown in FIG. 12, when the phase adjustment circuit 71 is built in or mounted near the output stage of the scan pulse SOUT (R_SOUT, G_SOUT, B_SOUT), the interconnects from the scan pulse SOUT pulse to the phase adjustment circuit 71 become the shortest in distance. Due to this, the distortions of the scan pulses due to the additional capacitances of the interconnects and the influence of the noise from the outside can be suppressed to the lowest limit.

As explained above, according to the LCD in the present embodiment, the display was configured so that phase adjustment circuits were built in and mounted near the output stages of the scan pulses R_SOUT, G_SOUT, and B_SOUT in the R, G, and B LCDs, the phase adjustment circuits sequentially calculated the amounts of phase deviations of the scan pulses SOUT (R_SOUT, G_SOUT, and B_SOUT) passed through the display units gradually changing one after another by the phase detectors, the phase difference between the amount of phase deviation and the phase difference of the initial value between the scan pulse SOUT set at the time of manufacture in advance and the pulse width control clock pulses DCK1 and DCK2 were compared, and the difference was reflected in the pulse width control clock pulses DCK1 and DCK2 in units of master clocks MCK, therefore the following effects can be obtained.

Namely, the disturbance of the video signals occurring due to delays of the switch pulses due to aging can be automatically eliminated. Further, the disturbance of the scan pulses serving as reference in timing adjustment is eliminated, and the timing adjustment can be automatically carried out by only entering the required signal into the LCD panel. Further, it becomes possible to suppress the disturbance of the scan pulses due to the additional capacitances of the interconnects and the influence of the noise from the outside to the lowest limit.

Summarizing the effects of the invention, according to the present invention, in a display having a display unit wherein pixels are arrayed in a matrix, the deviation of the phase relationships with the video signals can be automatically eliminated, so it becomes possible to always obtain the optimum display image without influence due to a temperature change or aging.

While the invention has been described with reference to specific embodiments chosen for purpose of illustration, it should be apparent that numerous modifications could be made thereto by those skilled in the art without departing from the basic concept and scope of the invention.

What is claimed is:

1. A display apparatus comprising:

at least two display units, each of which has a plurality of pixels arranged in a matrix;

a clock pulse generating unit which generates a clock pulse;

a pulse generating unit which includes a plurality of shift register units which each generate a separate timing pulse for groups of pixels in each display unit based on the clock pulse;

a write pulse generating unit which simultaneously generates a write pulse to the plurality of pixels in each display unit based on the timing pulse;

a detection unit which detects the rising and falling edges of the timing pulse generated by the last shift register to process the clock signal in each display unit and which calculates and generates a detection pulse;

at least one delay counter unit for each display unit which receives a reset count for each display unit and the clock pulse from the clock pulse generating unit and generates a delay pulse for each display unit based on the reset count and clock pulse; and a timing adjustment unit which receives the detection pulse for each display unit from the detection unit and the delay pulse for each unit and adjusts the timing pulse for each display unit separately by decoding the delay pulse based on the detection pulse to minimize the amount of the timing delay, wherein, the write pulse is sent in parallel to a subset of said plurality of pixels of each display unit.

2. A display apparatus as set forth in claim 1, wherein said pulse generating unit is configured to vary a phase of the write pulse by setting a phase difference of the timing pulse to the clock pulse.

3. A display apparatus as set forth in claim 1, wherein said detection unit includes an edge detection unit which detects either a rising edge or a falling edge of the reference pulse.

4. A display apparatus as set forth in claim 3, wherein said edge detection unit detects both the rising edge and the falling edge of the reference pulse.

5. A display apparatus as set forth in claim 1, wherein said detection unit further comprises a counter which determines the reference pulse delay, and a decoder which decodes the count of the counter by receiving the detection result of the edge detection unit, and sets a reset time of the counter to a desired value.

6. A display apparatus as set forth in claim 5, wherein said timing adjustment unit which selects the ON/OFF position of the feedback-processing for the reference pulse, and offsets the reset time when ON is selected.

7. A display apparatus comprising:

at least two display units each having a plurality of pixels arranged in a matrix;

a clock pulse generating unit which generates a clock pulse;

a pulse generating unit which includes a plurality of shift register units which each generate a separate timing pulse for groups of pixels in each display unit based on the clock pulse;

a write pulse generating unit which simultaneously generates a write pulse to the plurality of pixels in each display unit based on the timing pulse;

a detection unit which detects the rising and falling edges of timing pulse generated by the last shift register to process the clock signal in each display unit and which calculates and generates a detection pulse;

at least one delay counter unit for each display unit which receives a reset count for each display unit and the clock pulse from the clock pulse generating unit and generates a delay pulse for each display unit based on the reset count and clock pulse; and a timing adjustment unit which receives the detection pulse for each display unit from the detection unit and the delay pulse for each unit and adjusts the timing pulse for each display unit separately by decoding the delay pulse based on the detection pulse to minimize the amount of the timing delay, wherein, the write pulse is sent in parallel to a subset of said plurality of pixels of each of said display units, and the detection unit and the timing adjustment unit are located in close proximity to the reference pulse output portions of each display unit.

8. A projection type display apparatus for projecting a light emitted by a light source and displaying the light on a screen comprising:

at least two display units each having a plurality of pixels arranged in a matrix;

a clock pulse generating unit which generates a clock pulse;

a pulse generating unit which includes a plurality of shift register units which each generate a separate timing pulse for groups of pixels in each display unit based on the clock pulse;

a write pulse generating unit which simultaneously generates a write pulse to the plurality of pixels in each display unit based on the timing pulse;

a detection unit which detects the rising and falling edges of the timing pulse generated by the last shift register to process the clock signal in each display unit and which calculates and generates a detection pulse;

timing adjustment unit which receives the detection pulse for each display unit from the detection unit and the delay pulse for each unit and adjusts the timing pulse for each display unit separately by decoding the delay pulse based on the detection pulse to minimize the amount of the timing delay, wherein, the write pulse is sent in parallel to a subset the plurality of pixels of each of said display units.

9. A projection type display apparatus for projecting a light emitted by a light source and display the light on a screen comprising:

at least two display units each having a plurality of pixels arranged in a matrix;

a clock pulse generating unit which generates a clock pulse of a desired frequency;

a pulse generating unit which includes a plurality of shift register units which each generate a separate timing pulse for groups of pixels in each display unit based on the clock pulse;

a write pulse generating unit which simultaneously generates a write pulse to the plurality of pixels in each display unit based on the timing pulse;

a detection unit which detects the rising and falling edges of the timing pulse generated by the last shift register to process the clock signal in each display unit and which calculates and generates a detection pulse; at least one delay counter unit for each display unit which receives a reset count for each display unit and the clock pulse from the clock pulse generating unit and generates a delay pulse for each display unit based on the reset count and clock pulse; and a timing adjustment unit which receives the detection pulse for each display unit from the detection unit and the delay pulse for each unit and adjusts the timing pulse for each display unit separately by decoding the delay pulse based on the detection pulse to minimize the amount of the timing delay, wherein, the write pulse is sent in parallel to a subset of the plurality of pixels of each of said display units, and the detection unit and the timing adjustment unit are located in close proximity to the reference pulse output portions of each display unit.

* * * * *